US008727238B1

(12) United States Patent
Clark et al.

(10) Patent No.: US 8,727,238 B1
(45) Date of Patent: May 20, 2014

(54) IRRIGATION SPRINKLER WITH RE-CONFIGURABLE SECONDARY NOZZLE HOLDER

(75) Inventors: Michael L. Clark, San Marcos, CA (US); Ronald H. Anuskiewicz, San Diego, CA (US)

(73) Assignee: Hunter Industries, Inc., San Marcos, CA (US)

( * ) Notice: Subject to any disclaimer, the term of this patent is extended or adjusted under 35 U.S.C. 154(b) by 70 days.

(21) Appl. No.: 13/154,698

(22) Filed: Jun. 7, 2011

(51) Int. Cl.
*A62C 31/02* (2006.01)
*B05B 3/00* (2006.01)
*B05B 15/06* (2006.01)
*B05B 1/00* (2006.01)

(52) U.S. Cl.
USPC ..... 239/397; 239/390; 239/391; 239/206; 239/600

(58) Field of Classification Search
USPC ..... 239/237, 240, 200–206, 600, 548, 390, 239/391, 397, 392, 436, 246, 394
See application file for complete search history.

(56) References Cited

U.S. PATENT DOCUMENTS 3,149,784 A * 9/1964 Skidgel ..... 239/206
3,434,664 A * 3/1969 Friedmann et al. ..... 239/206
3,709,435 A * 1/1973 Sheets ..... 239/206
3,715,078 A * 2/1973 Reynolds ..... 239/206
3,921,911 A * 11/1975 Sheets ..... 239/206
4,014,502 A * 3/1977 Sheets ..... 239/206
4,113,181 A * 9/1978 Sheets ..... 239/206
4,625,914 A * 12/1986 Sexton et al. ..... 239/206
4,726,527 A * 2/1988 Mendenhall ..... 239/542
4,753,391 A * 6/1988 Rogers ..... 239/203
4,787,558 A * 11/1988 Sexton et al. ..... 239/205
5,123,597 A * 6/1992 Bendall ..... 239/124
5,199,646 A * 4/1993 Kah, Jr. ..... 239/240
5,226,599 A * 7/1993 Lindermeir et al. ..... 239/205
5,240,184 A * 8/1993 Lawson ..... 239/499
5,299,742 A * 4/1994 Han ..... 239/206
5,871,156 A * 2/1999 Lawson ..... 239/201
6,029,907 A * 2/2000 McKenzie ..... 239/240
6,237,862 B1 * 5/2001 Kah et al. ..... 239/391
6,491,235 B1 * 12/2002 Scott et al. ..... 239/206
6,732,950 B2 * 5/2004 Ingham et al. ..... 239/205
6,854,664 B2 * 2/2005 Smith ..... 239/205
7,017,831 B2 * 3/2006 Santiago et al. ..... 239/222.13
7,303,153 B2 * 12/2007 Han et al. ..... 239/461
7,404,525 B2 * 7/2008 Santiago et al. ..... 239/240
7,445,164 B2 * 11/2008 Liaw ..... 239/240
D593,182 S 5/2009 Anuskiewicz ..... D23/213
7,677,469 B1 * 3/2010 Clark ..... 239/242

(Continued)

OTHER PUBLICATIONS

I-40 Performance Rotor Brochure of Hunter Industries, Inc., The Irrigation Innovators® dated Apr. 2011 (4 pages).

*Primary Examiner* — Len Tran
*Assistant Examiner* — Alexander M Valvis
(74) *Attorney, Agent, or Firm* — Knobbe, Martens, Olson & Bear LLP

(57) ABSTRACT

An irrigation sprinkler has a riser assembly that includes a rotatably mounted nozzle turret, a secondary nozzle holder removably mounted on the nozzle turret, and a turbine. A drive assembly is mounted in the riser assembly and couples the turbine and the nozzle turret so that pressurized water entering a lower end of the riser assembly will cause the nozzle turret to rotate. The nozzle turret has a primary nozzle and the secondary nozzle holder has at least one secondary nozzle.

18 Claims, 15 Drawing Sheets

(56) References Cited

U.S. PATENT DOCUMENTS 8,177,148 B1 * 5/2012 Renquist et al. ..... 239/587.1
8,556,193 B2 * 10/2013 Anuskiewicz ..... 239/204
2002/0092924 A1 * 7/2002 Ingham et al. ..... 239/205
2005/0167526 A1 * 8/2005 McKenzie et al. ..... 239/225.1
2010/0276512 A1 * 11/2010 Nies et al. ..... 239/240
2011/0079661 A1 * 4/2011 Barton ..... 239/201

* cited by examiner

IRRIGATION SPRINKLER WITH RE-CONFIGURABLE SECONDARY NOZZLE HOLDER

FIELD OF THE INVENTION

The present invention relates apparatus for irrigating turf and landscaping, and more particularly, to rotor-type sprinklers having a rotatable nozzle turret.

BACKGROUND OF THE INVENTION

In many parts of the United States, rainfall is insufficient and/or too irregular to keep turf and landscaping green and therefore irrigation systems are installed. Such systems typically include a plurality of underground pipes connected between sprinklers and valves, the latter being controlled by an electronic irrigation controller. One of the most popular types of sprinklers is the pop-up rotor-type sprinkler. In this type of sprinkler a tubular riser is normally retracted into an outer cylindrical case by a coil spring. The case is buried in the ground and when pressurized water is fed to the sprinkler the riser extends. A turbine and a gear train reduction are mounted in the riser for rotating a nozzle turret at the top of the riser. The gear train reduction is often encased in its own housing which is referred to as a gear box. A reversing mechanism is also normally mounted in the riser along with an arc adjustment mechanism.

Oscillating rotor-type sprinklers with adjustable arc limits as well as non-oscillating sprinklers that run continuously in one direction have been extensively commercialized. Typically oscillating sprinklers have used reversing mechanisms that change the direction of rotation when the sprinkler reaches pre-set arc positions. Non-oscillating sprinklers typically do not include a reversing mechanism. It is becoming more common to have universal sprinklers that can be adjusted to operate in either an oscillating mode or a non-oscillating mode. Large versions of these sprinklers often have more than one nozzle mounted in the nozzle turret. Typically one primary nozzle and one or more secondary nozzles are mounted in the nozzle turret. The primary nozzle is used to spray a long stream of water that extends far out over the landscaping, sometimes one hundred feet or further. The secondary nozzles are used to spray shorter streams of water that irrigate adjacent areas of the turf and landscaping over which the long water stream extends. Sometimes the primary nozzle and the secondary nozzles are integrally formed as part of the same replaceable nozzle which can be removably inserted into the nozzle turret as one piece. See, for example, U.S. Design Pat. No. D593,182 S of Ronald H. Anuskiewicz, assigned to Hunter Industries, Inc., the assignee of the subject application.

SUMMARY OF THE INVENTION

In accordance with the present invention an irrigation sprinkler has a riser assembly that includes a rotatably mounted nozzle turret, a secondary nozzle holder removably mounted on the nozzle turret, and a turbine. A drive assembly is mounted in the riser assembly and couples the turbine and the nozzle turret so that pressurized water entering the riser assembly will cause the nozzle turret to rotate. The nozzle turret has a primary nozzle and the secondary nozzle holder has at least one secondary nozzle.

DETAILED DESCRIPTION

Figure 1:
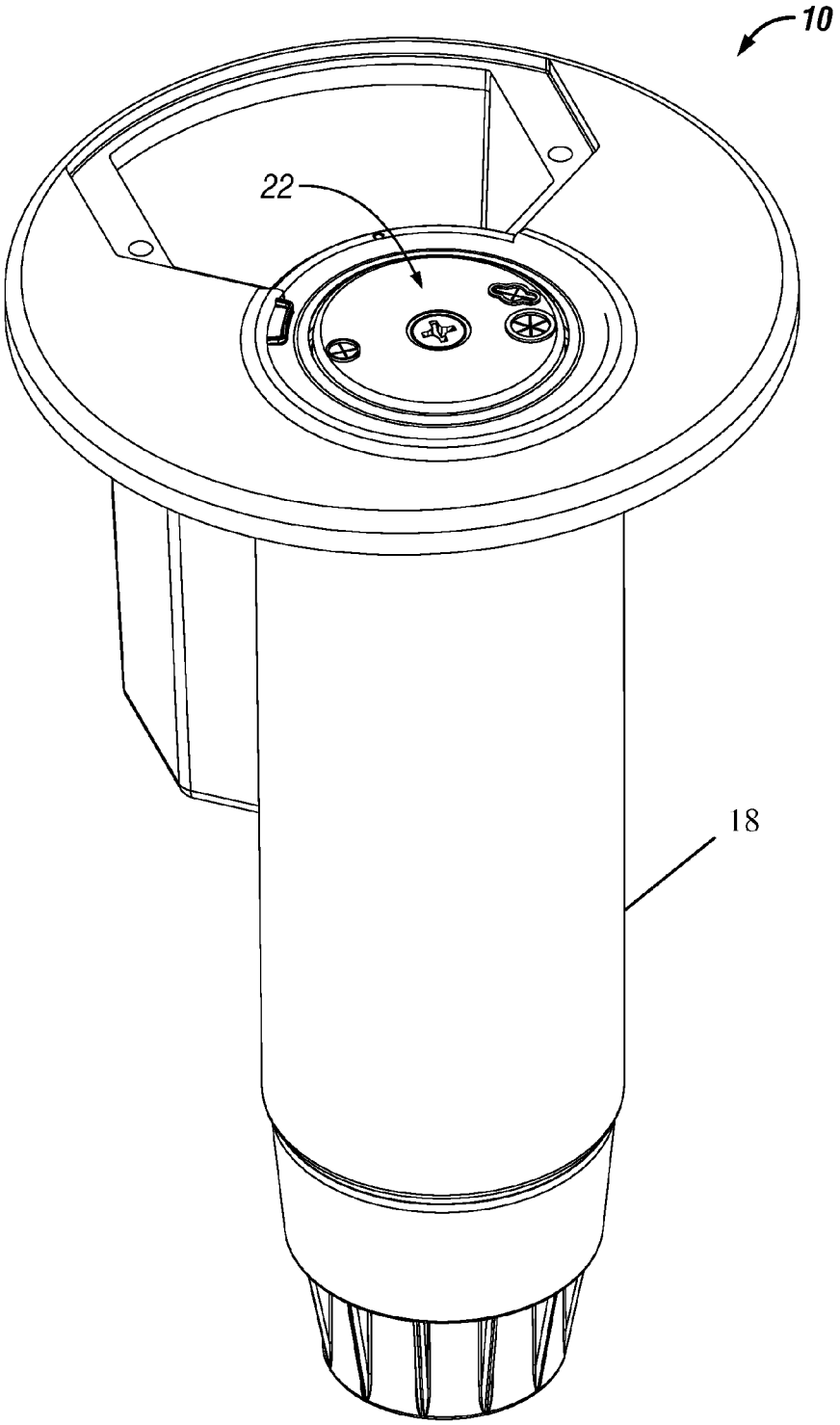
FIG. 1 is an isometric view of a pop-up rotor-type sprinkler in accordance with an embodiment of the present invention viewed from its top side. The riser assembly of the sprinkler is in its retracted position in this view.

When a user is installing a rotor-type irrigation sprinkler that includes separate secondary nozzles, it is desirable that the user have the ability to efficiently install the secondary nozzles in the correct positions to efficiently irrigate the property. It may also be beneficial for a user to change the secondary nozzles during the season.

In accordance with the present invention, a sprinkler includes a turbine, a gear train reduction and a rotating nozzle turret. The nozzle turret includes a port to mount a primary nozzle. The nozzle turret carries a removable portion where secondary nozzles can be installed. The removable portion allows for secondary nozzles to be placed in a forward direction in order to spray water in the same direction as the primary nozzle. This is typically done when the sprinkler is irrigating a part circle and the sprinkler oscillates between pre-set arc limits to irrigate a specific area of coverage. The removable portion of the nozzle turret also allows for secondary nozzles to be placed in a rear facing direction so that the secondary nozzles spray water in a direction opposite to that sprayed by the primary nozzle. This is typically done when a sprinkler is irrigating a full circle pattern in a one continuous direction. This allows the water being emitted from the secondary nozzles to at least partially offset the forces of the water being sprayed form the primary nozzle to reduce the significant side forces on the sprinkler. The removable portion carried by the nozzle turret also permits the secondary nozzles to be placed in both a forward facing direction and in a rear facing direction. This configuration may be desired, for example, on a golf course when a sprinkler is installed at the edge of a manicured fairway in front of the sprinkler and a rough landscaped area behind it. In this case, the sprinkler may be pre-set to rotate back and forth over a one hundred and eighty degree arc. The primary nozzle and the forward facing primary and secondary nozzles may be used to irrigate the manicured fairway while the smaller flow secondary nozzles provide less water to the rough landscaped area. In certain applications where a shorter radius of water is required from the sprinkler, a plug may be installed in a primary nozzle receiving socket so that only one or more secondary nozzles are used to irrigate the landscape. Additionally, the present invention allows the user to easily change the secondary nozzles at different times of the season. For instance, weather conditions and plant materials may not require the rough landscaped area to be irrigated throughout an entire year. The user may want to change the secondary nozzles during certain parts of the year to conserve water.

The removable portion carried by the nozzle turret is referred to herein as the "secondary nozzle holder." The secondary nozzle holder may be removed for ease of installing or removing the secondary nozzles, or it may be easily exchanged with another secondary nozzle holder that has secondary nozzles already installed at the new desired locations. The secondary nozzle holder may be installed with the secondary nozzles facing forward or rearwards by rotating the secondary nozzle holder to the proper orientation during installation. This allows the secondary nozzles to be positioned correctly for the specific application and does not require the secondary nozzles to be removed from the secondary nozzle holder whether adjusting the sprinkler to operate in a part circle oscillating mode or in a full circle three hundred and sixty degree continuous rotation mode. By installing the secondary nozzles in an easy to remove holder that is separate from the main body of the nozzle turret, a user can easily set up the secondary nozzles without having to do the work at ground level, and easily replace the secondary nozzle holder with the secondary nozzles ready to operate. The secondary nozzle holder may be removed and re-installed with the riser assembly in its fully retracted position where the nozzle turret is completely surrounded by the outer case. It may also be removed and re-installed with the riser assembly in an extended position by extending the riser out of the outer body and holding it in the extended position with an appropriate tool. A HUNTER® sprinkler maintenance tool similar to the tool Illustrated in FIG. 8 of U.S. Pat. No. 6,042,021 of Mike Clark may be used to pull the riser assembly out of the outer body. The nozzle turret and the removable secondary nozzle holder can be installed on any type of gear drive rotary sprinkler including, but not limited to, a sprinkler with a staggered gear reduction of the type illustrated in U.S. Pat. No. 7,828,230 of Ronald H. Anuskiewicz et al., or a sprinkler with a planetary gear drive of the type illustrated in U.S. Pat. No. 7,677,469 of Michael L. Clark et al. The aforementioned '021, '230 and '469 patents are all assigned to Hunter Industries, Inc. and their entire disclosures are hereby incorporated by reference.

The entire disclosure of U.S. patent application Ser. No. 12/710,298 filed Feb. 22, 2010, naming of Michael L. Clark and Zachary B. Simmons as co-inventors and entitled "Sprinkler with Reversing Planetary Gear Drive Including Two Ring Gears with Different Profiles" is also hereby incorporated by reference. The entire disclosure of U.S. patent application Ser. No. 12/710,265 also filed Feb. 22, 2010, naming of Michael L. Clark and Zachary B. Simmons as co-inventors and entitled "Reversing Mechanism for an Irrigation Sprinkler with a Reversing Planetary Gear Drive" is also hereby incorporated by reference. Both of the aforementioned applications are assigned to Hunter Industries, Inc.

Figure 2:
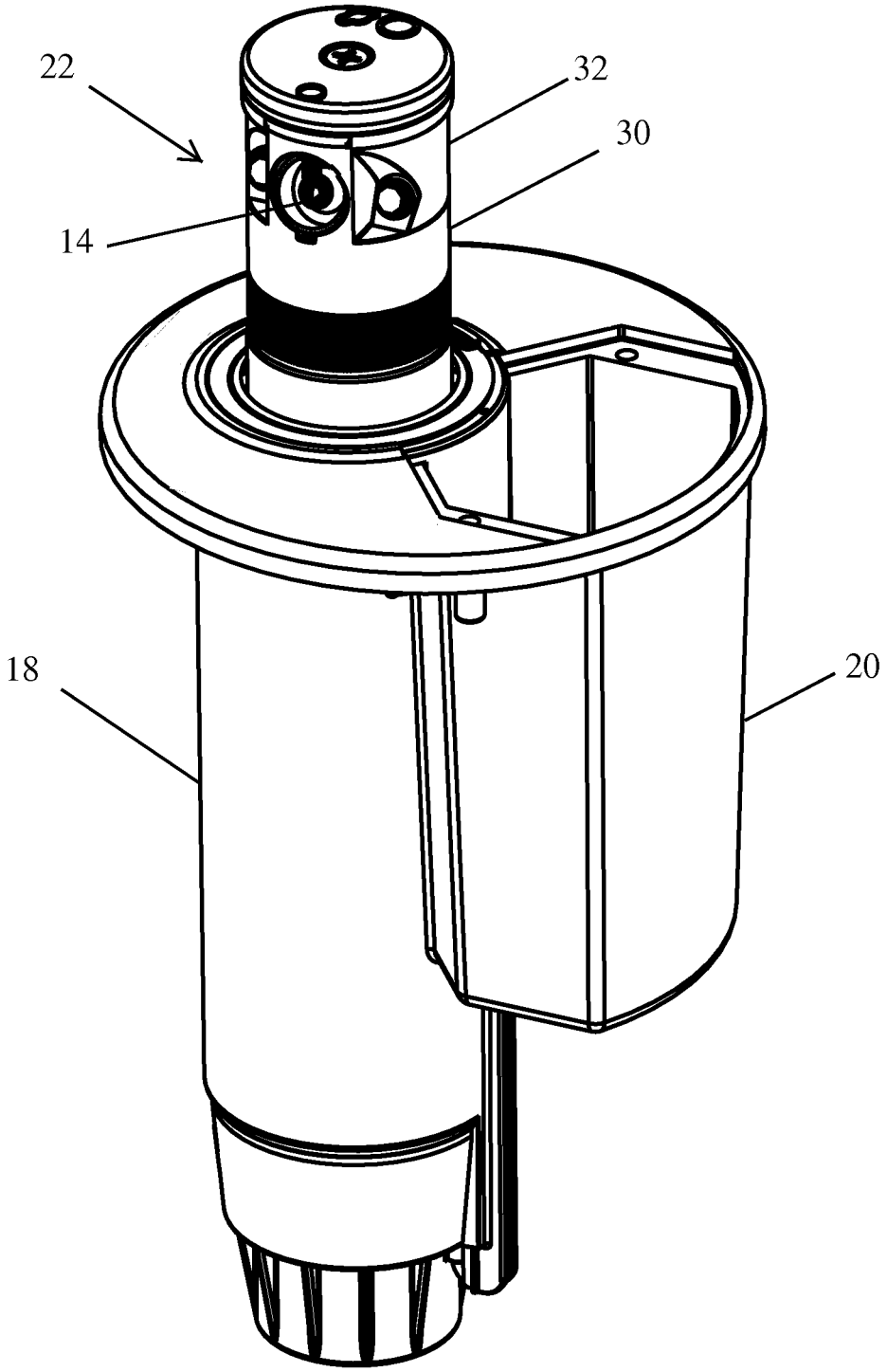
FIG. 2 is an isometric view of the sprinkler of FIG. 1 with its riser assembly in its extended position
Figure 3:
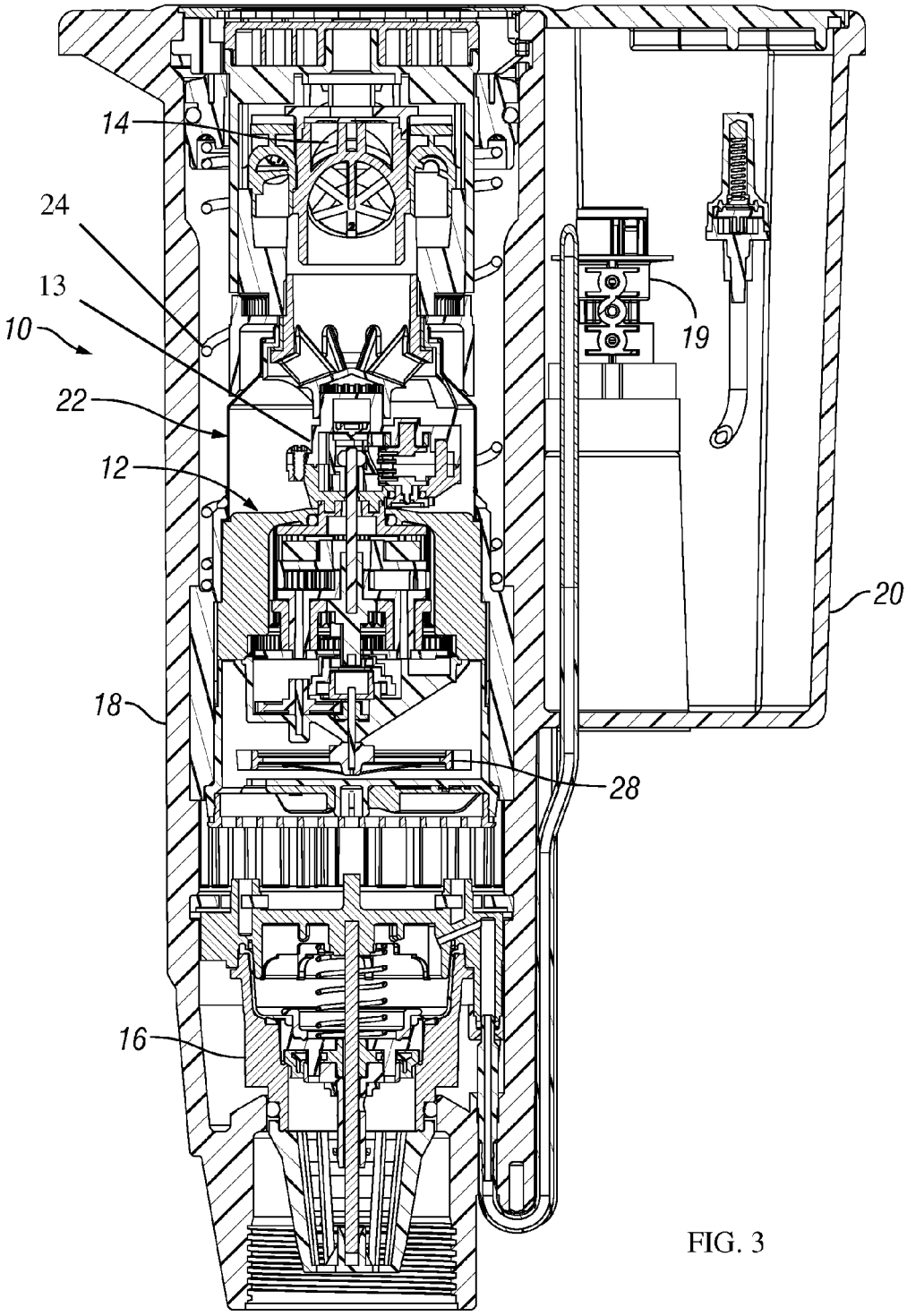
FIG. 3 is a vertical sectional view of the sprinkler of FIG. 1.

Referring to FIG. 1, in accordance with an embodiment of the present invention a rotor-type sprinkler 10 incorporates an inner extendable riser assembly 22 mounted in an outer cylindrical housing 18. The upper end of the extendable riser assembly 22 includes a rotatable nozzle turret 30 (FIG. 2) and a removable secondary nozzle holder 32. The nozzle turret 30 supports a removable primary nozzle 14. A gear train reduction 12 (FIG. 3) rotates or oscillates the nozzle turret 30 and the primary nozzle 14 carried therein between pre-set arc limits. The primary nozzle 14 may have a dual trajectory capability as disclosed in U.S. patent application Ser. No. 12/957,109 filed Nov. 30, 2010 of Richard D. Dunn et al. entitled "Dual Trajectory Nozzle for Rotor-Type Sprinkler," the entire disclosure of which is hereby incorporated by reference. Said application is also assigned to Hunter Industries, Inc. Except for the gear train reduction 12, and an additional reversing mechanism 13 with a control portion located externally of the gear train reduction 12 and a reversing portion located internally of the gear reduction 12, the sprinkler 10 has a construction similar to that disclosed in U.S. Pat. No. 6,491,235 of Scott et al. granted Dec. 10, 2002, assigned to Hunter Industries, Inc., the entire disclosure of which is hereby incorporated by reference. The sprinkler 10 may also have a construction illustrated in the other previously cited patents and patent applications that are assigned to Hunter Industries, Inc. The sprinkler 10 is a so-called valve-in-head sprinkler that incorporates a valve 16 in the bottom of the outer housing 18 which is opened and closed by valve actuator components 19 contained in a housing 20 on the side of the outer housing 18. A coil spring 24 normally holds the riser assembly 22 in a retracted position within the outer housing 18. The primary nozzle 14 is carried inside the cylindrical nozzle turret 30 that is rotatably mounted to the upper end of the riser assembly 22. The coil spring 24 is compressible to allow the riser assembly 22 including the nozzle turret 30 and secondary nozzle housing 32, to telescope from their retracted positions to their extended positions when pressurized water is introduced into the female threaded inlet at the lower end of the cylindrical housing 18.

Figure 4:
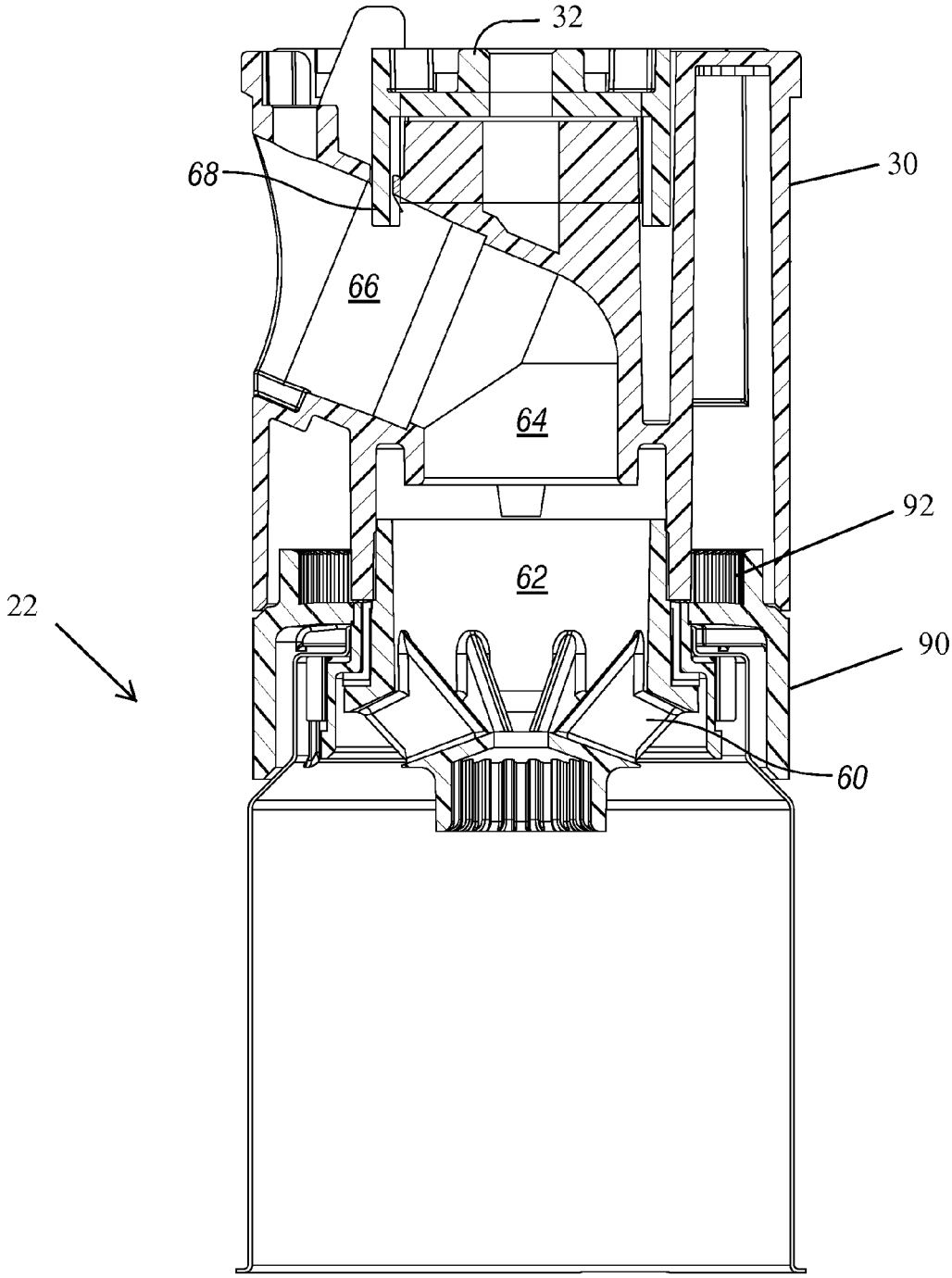
FIG. 4 is an enlarged vertical sectional view of the nozzle turret and the secondary nozzle holder of the sprinkler of FIG. 1 rotated ninety degrees about its vertical axis relative to the orientation illustrated in FIG. 3.
Figure 5:
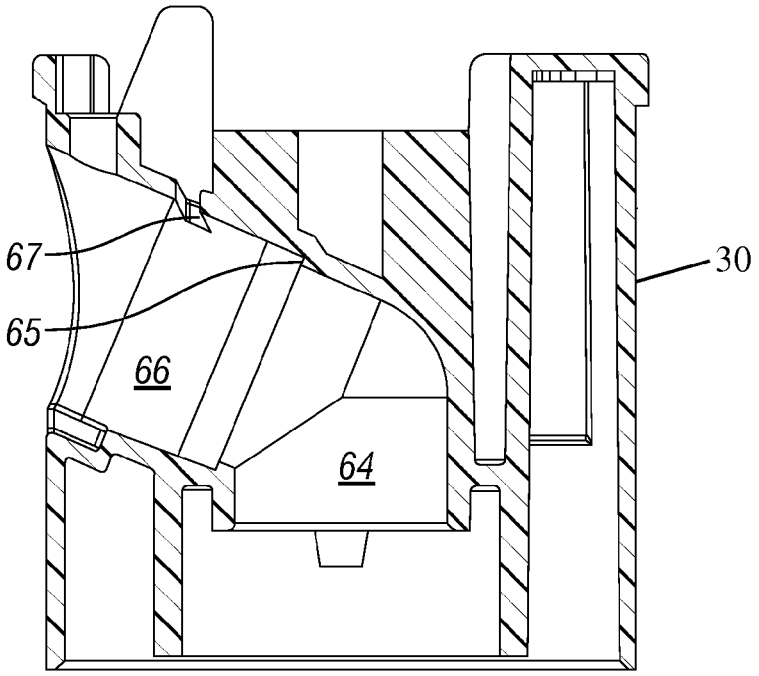
FIG. 5 is an enlarged portion of FIG. 4 illustrating further details of the nozzle turret of the sprinkler of FIG. 1 with its primary nozzle removed.
Figure 6:
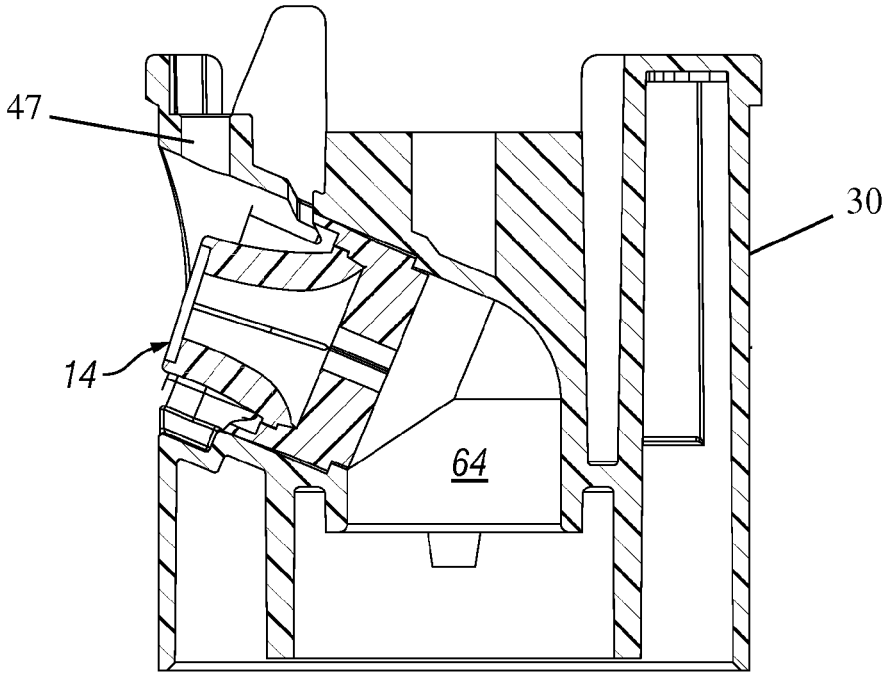
FIG. 6 is a view of the nozzle turret similar to FIG. 5 with the primary nozzle installed.
Figure 11:
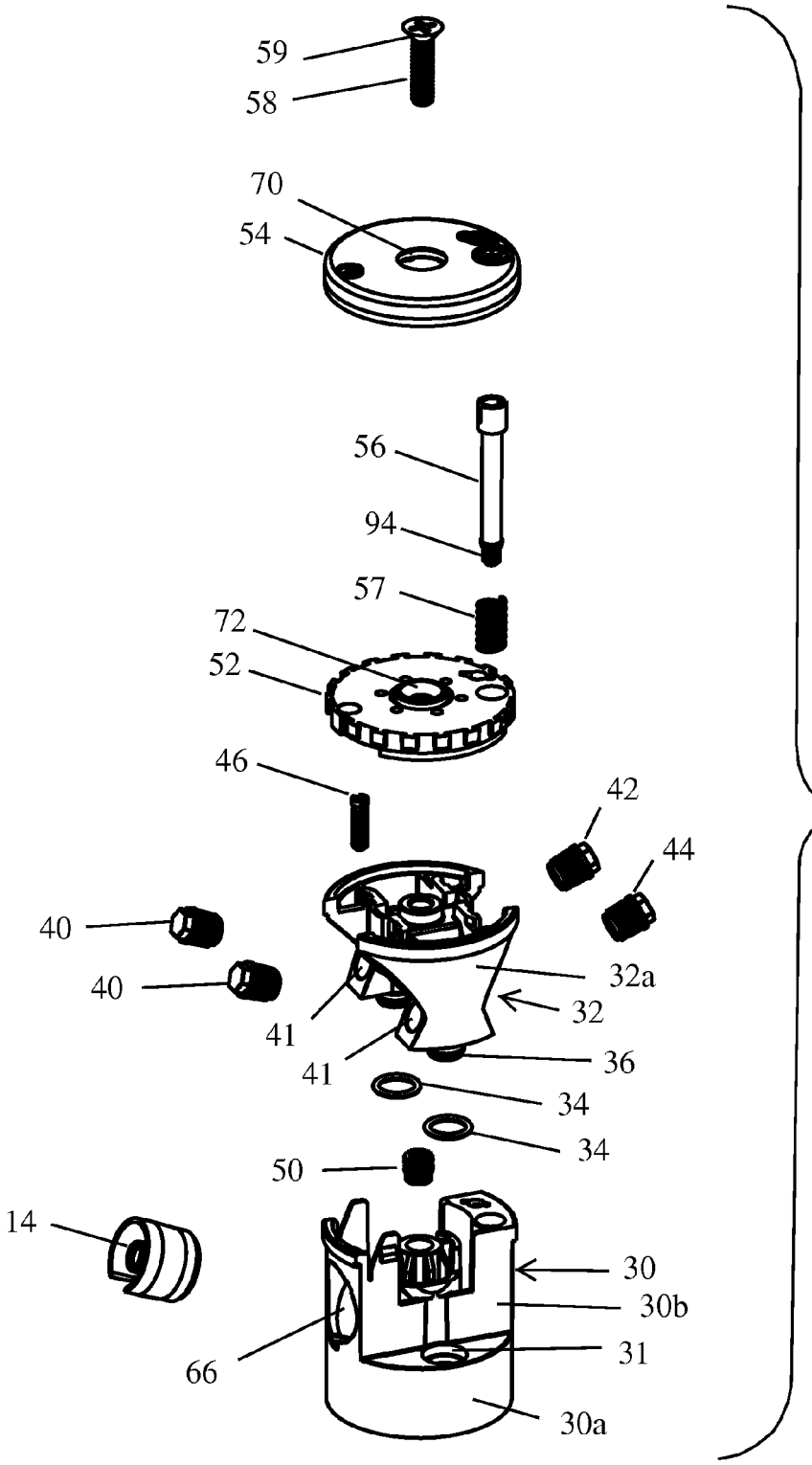
FIG. 11 is a fully exploded view of the nozzle turret and the secondary nozzle holder illustrated in FIG. 9.

FIG. 4 illustrates details of the nozzle turret 30 and the secondary nozzle holder 32 of the sprinkler of FIG. 1. Pressurized water passes through the valve 16, flows past the gear train reduction 12, and flows upwardly through a central cylindrical vertical port 62. Pressurized water flows through the port 62 into the nozzle turret 30. Thus the nozzle turret 30 has a vertically extending primary port 64 that communicates with an exit port 66 that extends at a predetermined angle relative to the primary port 64 and provides a nozzle receiving socket. The primary nozzle 14 (FIG. 6) can be manually inserted into the exit port 66 and is held in position by a retention tab 68. The retention tab 68 is formed as part of the secondary nozzle holder 32 which is attached to the nozzle turret 30 by a retention screw 58 (FIG. 11). Other types of mechanical fasteners can be used instead of the retention screw 58, including, but not limited to, clips, studs, springs, pins and snap rings. The retention tab 68 passes through a slot 67 (FIG. 5) that intersects with the exit port 66. When the secondary nozzle holder 32 is removed, the primary nozzle 14 can be slid into its operative position in exit port 66 as best seen in FIG. 6. When the secondary nozzle holder 32 is assembled onto the nozzle turret 30, the retaining tab 68 passes through the slot 67 to capture the primary nozzle 14 in its assembled location.

Figure 7:
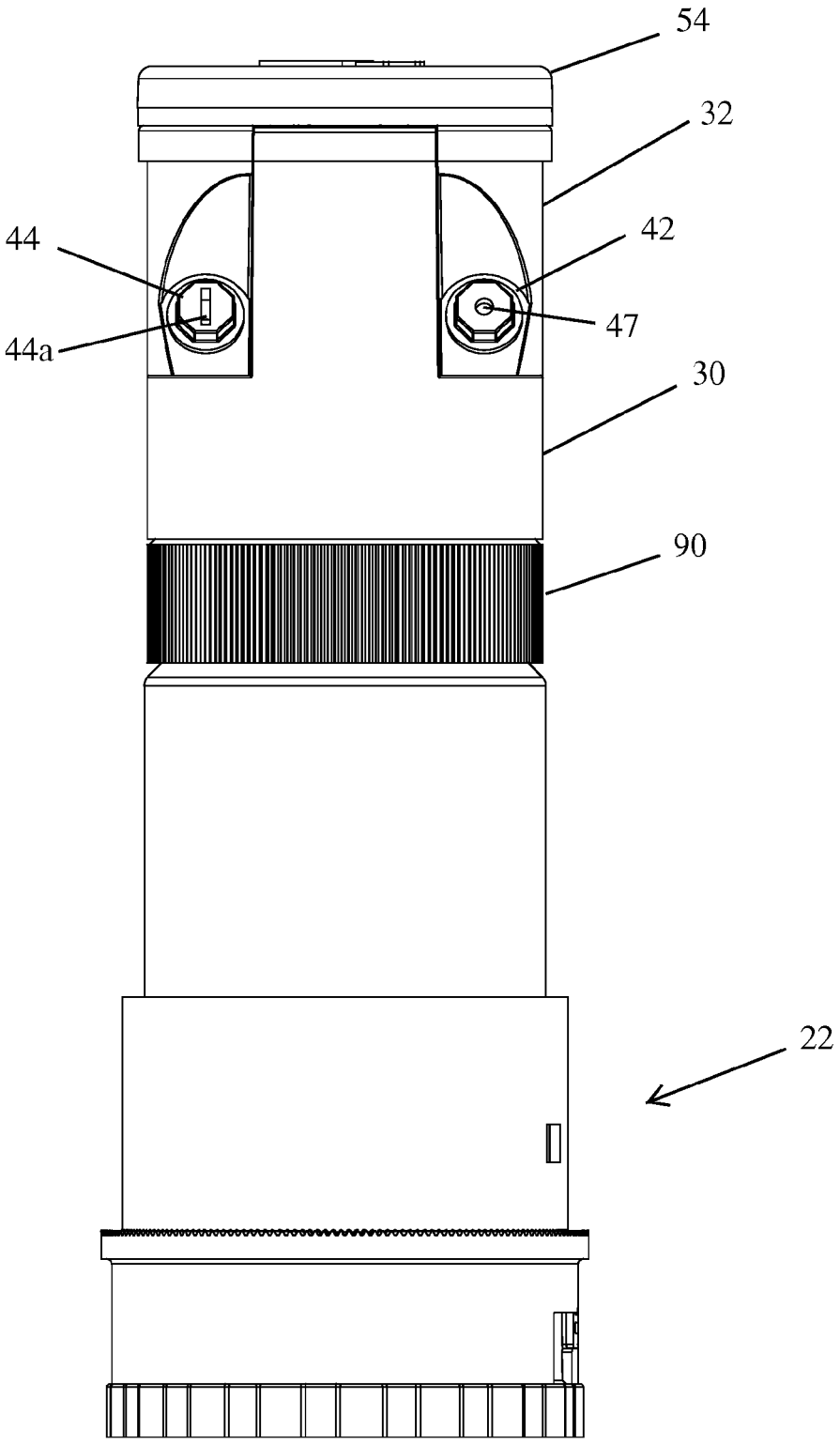
FIG. 7 is a side elevation view of the riser assembly of the sprinkler of FIG. 1 taken from the rear side with the secondary nozzles installed on the side opposite the primary nozzle.
Figure 8:
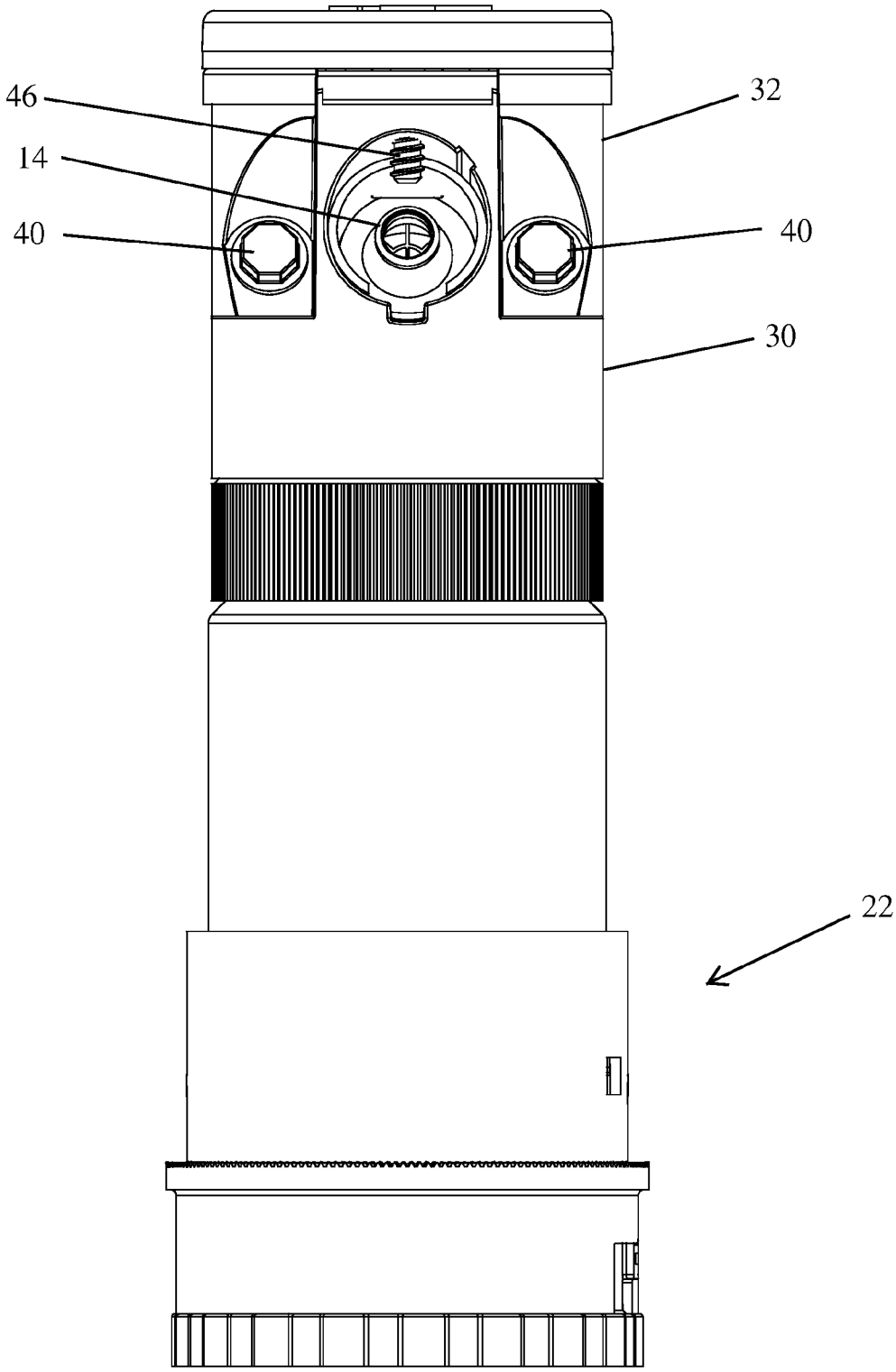
FIG. 8 is a view of the riser assembly similar to FIG. 7 taken from the front side with secondary plugs installed on the same side as the primary nozzle.
Figure 9:
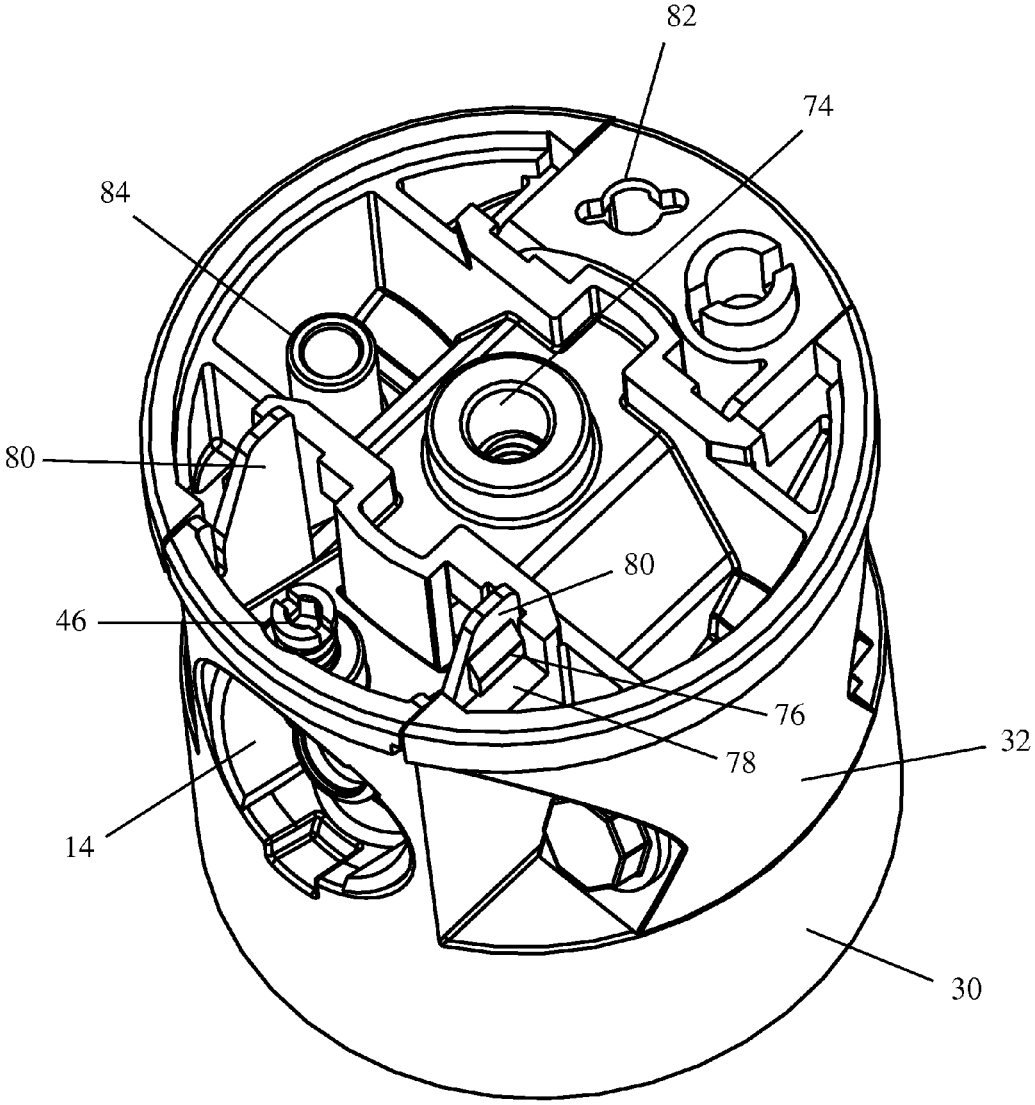
FIG. 9 is an enlarged isometric view of the assembled nozzle turret and the secondary nozzle holder taken from above.
Figure 10:
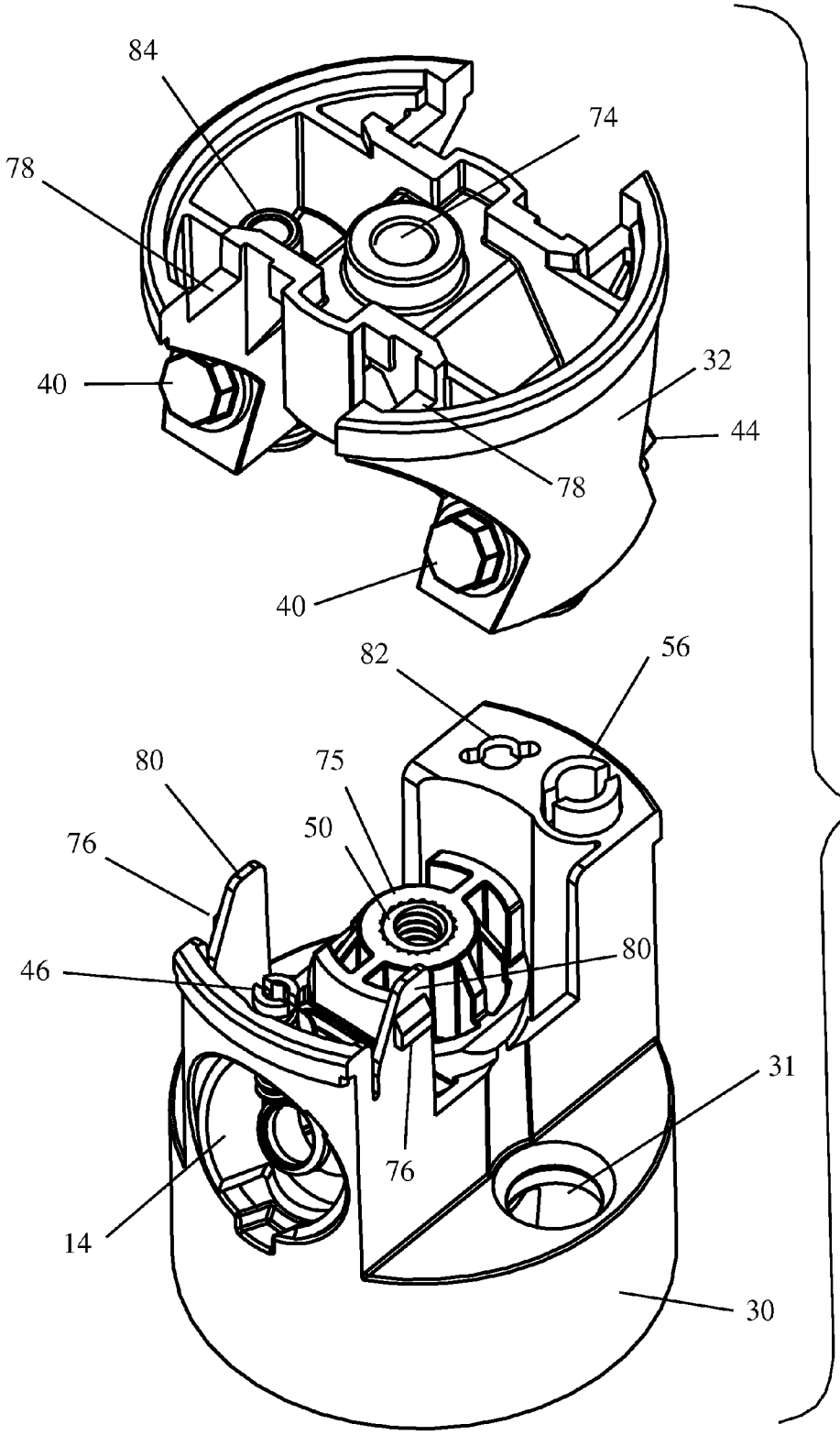
FIG. 10 is a partially exploded isometric view of the nozzle turret and the secondary nozzle holder of FIG. 9 illustrating two secondary plugs installed on the same side as the primary nozzle.
Figure 16:
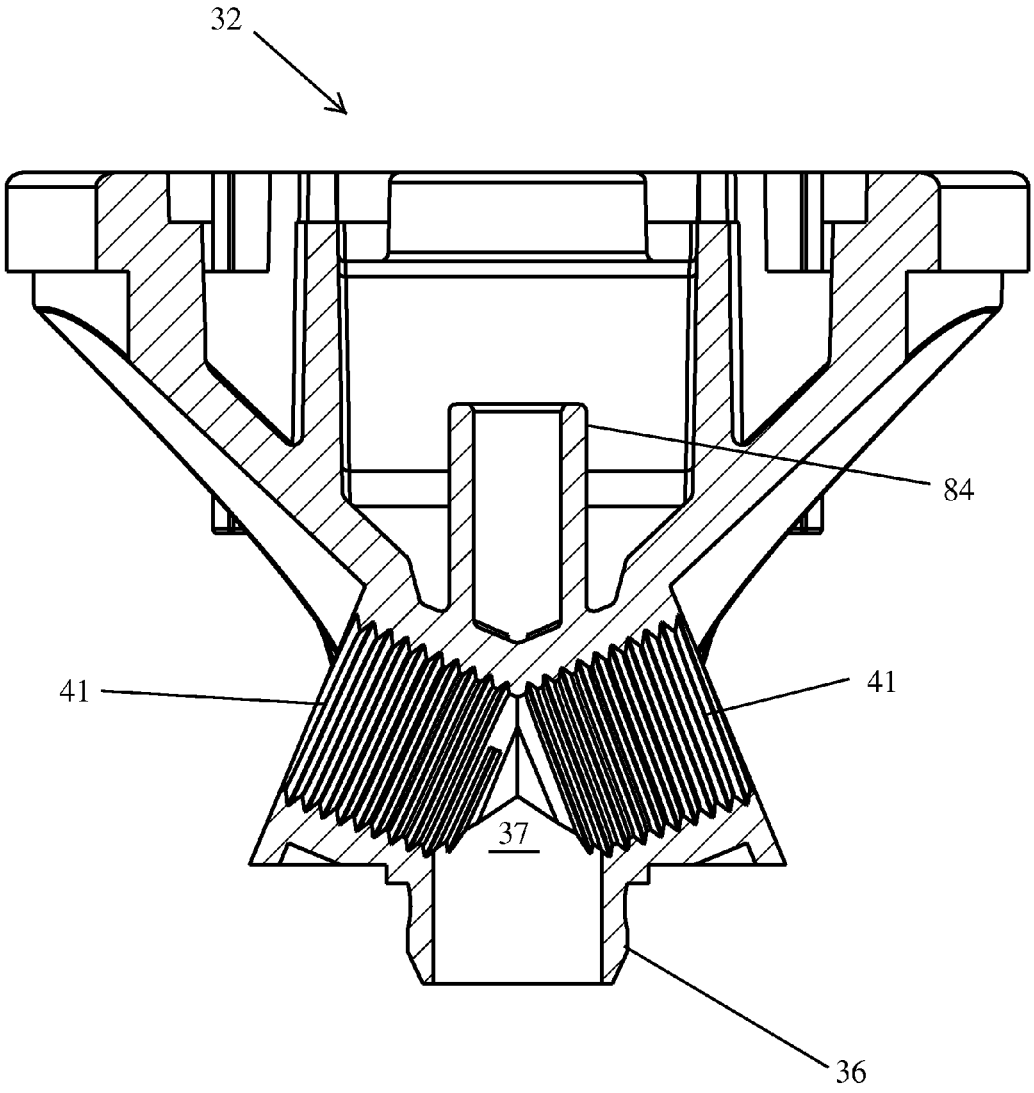
FIG. 16 is an enlarged vertical sectional view through the secondary nozzle holder illustrating the flow channels that lead from the flow tubes that plug into the cavities in the nozzle turret.

FIG. 7 illustrates a pair of secondary nozzles 42 and 44 installed in the rear side of the secondary nozzle holder 32 so that they can distribute water in an opposing direction to that of the primary nozzle 14. FIG. 8 illustrates the same mounting configuration from the front side of the nozzle turret 30. The primary nozzle 14 is installed in the front side of the nozzle turret 30. Two secondary plugs 40 are installed in the front side of the secondary nozzle holder 32 to prevent any secondary water form exiting the same direction as water exiting the primary nozzle 14. This is typical of a sprinkler that is set to water a continuous three hundred and sixty degree pattern. FIG. 9 illustrates the nozzle turret 30 and secondary nozzle holder 32 without its flexible cover 54, rigid cover base 52, and retention screw 58. A pair of flexible arms 80 is formed on the nozzle turret 30 and protrude up above corresponding locking flats 78 that are formed in the secondary nozzle holder 32. A pair of locking tabs 76 is formed on the flexible locking arms 80 to secure the secondary holder 32 to the nozzle turret 30. This locking retention mechanism reduces the chances that the secondary nozzle holder 32 will eject upwardly at a dangerous speed if the pressurized water connected to the sprinkler 10 is inadvertently turned ON prior to installing and tightening the retention screw 58. During a servicing operation, when the water to the sprinkler 10 is shut OFF, the flanged lower end of the HUNTER® sprinkler maintenance tool can be inserted into a slotted bore 82 (FIG. 9) formed in the top side of the secondary nozzle holder 32 and then twisted to allow the user to pull up and extend the riser assembly 22 from the outer housing 18. This exposes the nozzle turret 30 above the outer housing 18 for servicing. The user can also employ a separate tool (not illustrated) that clamps onto the exterior of the riser assembly 22 to keep the riser assembly 22 extended from the outer housing 18. A user can remove the secondary nozzle holder 32 (FIG. 10) by squeezing the flexible arms 80 inwardly towards each other between the thumb and index finger to move the locking tabs 76 clear of the locking flats 78. A vertically extending tubular sleeve 84 (FIGS. 10 and 16) is formed in the secondary nozzle holder 32 to provide a place for the user to store the retention screw 58 after it has been removed to allow the secondary nozzle holder 32 to be removed and the nozzles 42 and 44 and the secondary plugs 40 to be serviced. The tubular sleeve 84 thus provides convenient storage to help prevent the retention screw 58 from being lost in the surrounding landscape.

The exit port 66 (FIGS. 5 and 11) in nozzle turret 30 removably receives the primary nozzle 14 (FIG. 11). Elastomeric O-rings 34 are installed on a pair of vertically extending flow tubes 36 formed on the underside of the secondary nozzle holder 32. The secondary nozzle holder 32 is mated to nozzle turret 30 such that the O-rings 34 contact the upwardly facing surfaces of a pair of tapered cavities 31 formed in the nozzle turret 30. The cavities 31, only one of which is visible in FIG. 11, communicate with the hollow interior of the nozzle turret 30. The O-rings 34 provide seals between the nozzle turret 30 and the secondary nozzle holder 32. These seals prevent pressurized water from escaping between the nozzle turret 30 and the secondary nozzle holder 32 when the pressurized water is turned ON.

The secondary plugs 40 and the secondary nozzles 42 and 44 can be installed in any of four secondary nozzle ports 41 formed on either side of the secondary nozzle holder 32 to meet the requirements of the landscape area. The secondary nozzle holder 32 is formed with a pair of vertically extending flow channels 37 (FIG. 16) that lead from the flow tubes 36 to the female threaded secondary nozzle ports 41. Together each flow channel 37 and its associated pair of upwardly angled secondary nozzle ports 41 form a Y-shaped flow path that can convey water from the corresponding flow tube 36 to either the front side of the secondary nozzle holder 32 or the rear side of the secondary nozzle holder 32. A primary nozzle radius reduction screw 46 is threaded into a vertical bore 47 (FIG. 6) formed in the nozzle turret 30. The user can rotate the radius reduction screw 46 such that it lowers to intersect the water emitted from the primary nozzle 14 to reduce its radius of coverage.

A coil spring 57 (FIG. 11) surrounds an arc adjusting shaft 56 when inserted into the nozzle turret 30. Gear teeth 94 on the bottom of the arc adjusting shaft 56 engage with a plurality of internal ring gear teeth 92 (FIG. 4) formed on an adjusting ring 90 to provide arc stop adjustability from the top of the sprinkler 10. A female threaded cylindrical brass insert 50 (FIG. 11) is press fit into a cylinder 75 formed in the central portion of the top of the nozzle turret 30. The flexible elastomeric cover 54 is snapped onto the cover base 52. The retention screw 58 extends through a clearance hole 70 in the elastomeric cover 54. The tapered head 59 of the retention screw 58 engages with a countersink surface 72 to securely hold the cover base 52 and the secondary nozzle holder 32 to the nozzle turret 30. The threaded shank of the retention screw 58 extends through a bore 74 in the secondary nozzle holder 32 and is screwed into the female threaded insert 50.

Figure 12:
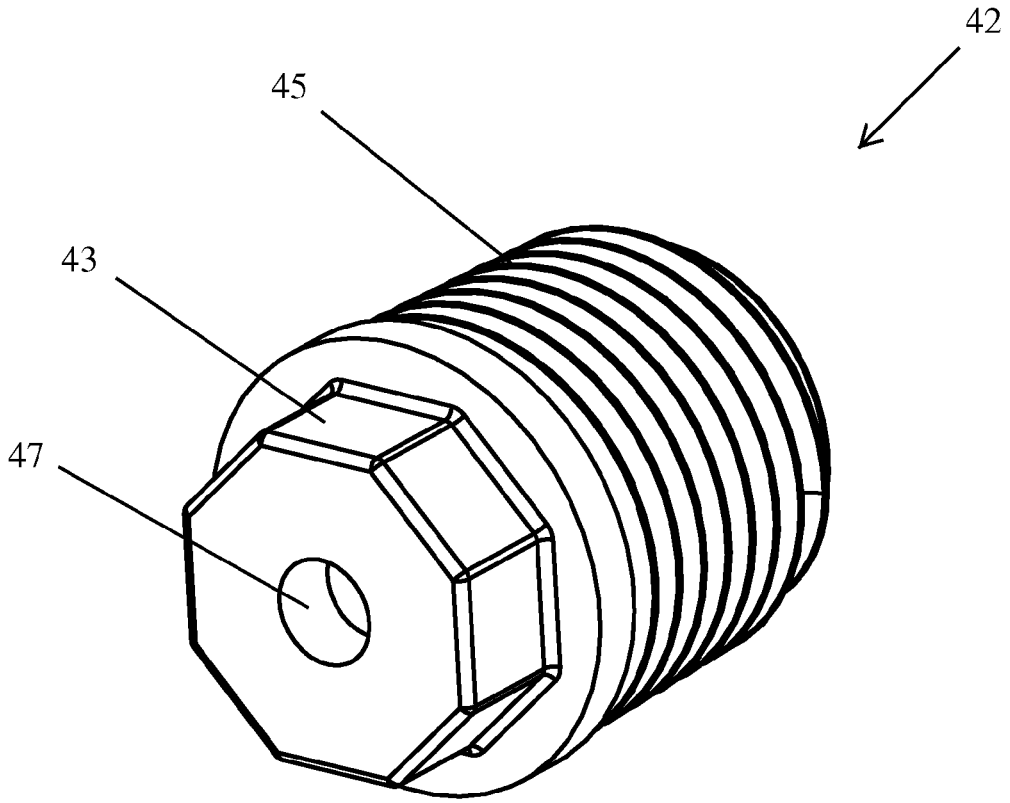
FIG. 12 is a greatly enlarged isometric view of one of the secondary nozzles.

The secondary nozzle 42 has a hexagonal forward portion including a plurality of wrench flats 43 (FIG. 12) which can be engaged with a wrench, piers or other appropriate hand tool (not illustrated) to secure the secondary nozzle 42 into the secondary nozzle holder 32. Male threads 45 on the shank portion of the secondary nozzle 42 engage with mating female threads formed in the secondary nozzle holder 32. Pressurized water is emitted from a cylindrical nozzle port 47 formed in the center of the secondary nozzle 42 during operation to irrigate the landscaped area that is relatively close to the sprinkler 10. The shape and size of the nozzle port 47 may vary depending on performance requirements. The nozzle port 44*a* (FIG. 7) of the secondary nozzle 44 has an elongated vertical slit configuration. The cross-sectional area of the nozzle port 47 is preferably significantly less than the cross-sectional area of the central outlet of the primary nozzle 14. The radius of throw or reach of the stream of water that is ejected from the secondary nozzle 42 is thus significantly less than that of the stream of water that is ejected from the primary nozzle 14.

Figure 13:
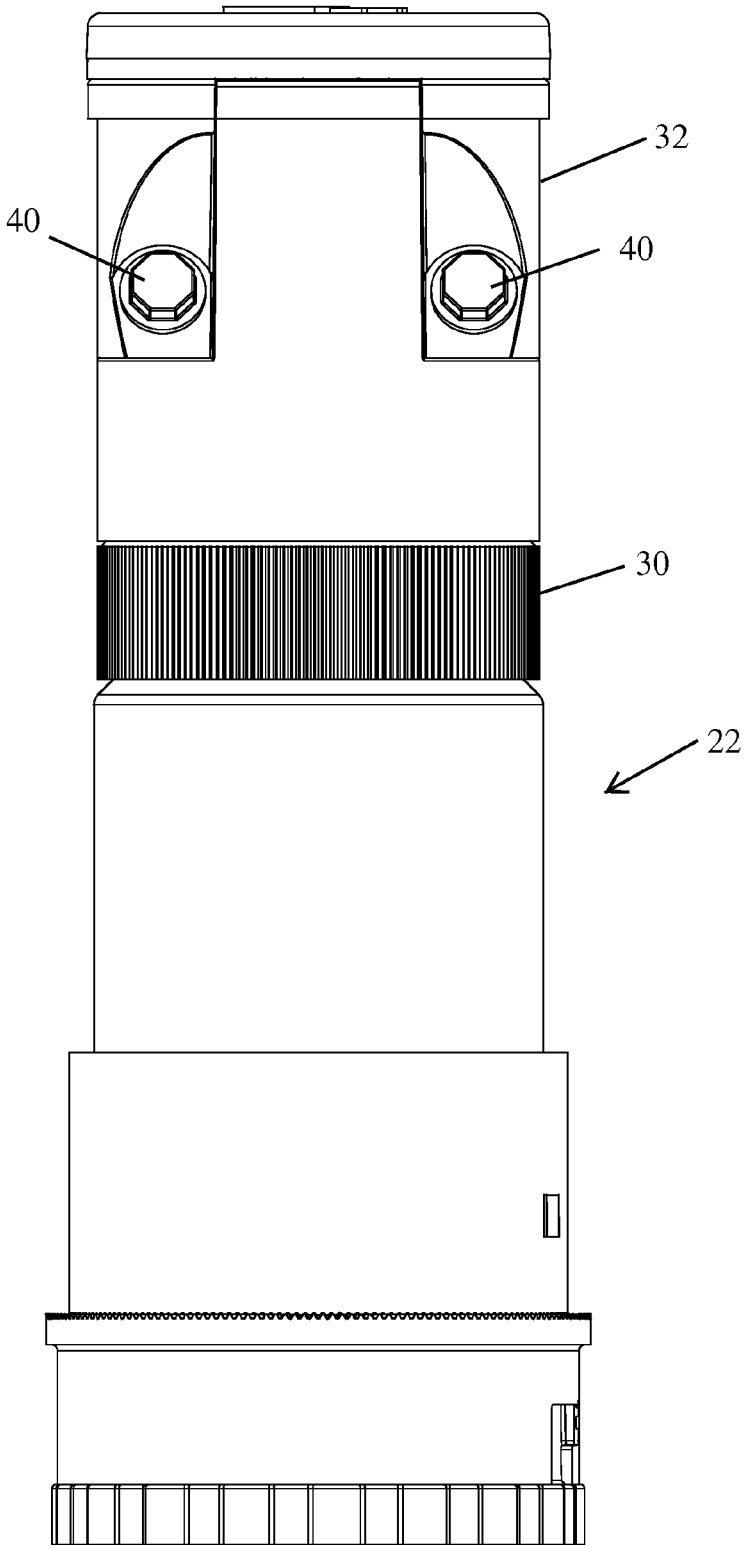
FIG. 13 is a side elevation view of the riser assembly similar to FIG. 7 but instead illustrating secondary plugs installed on the side opposite the side in which the primary nozzle is installed.
Figure 14:
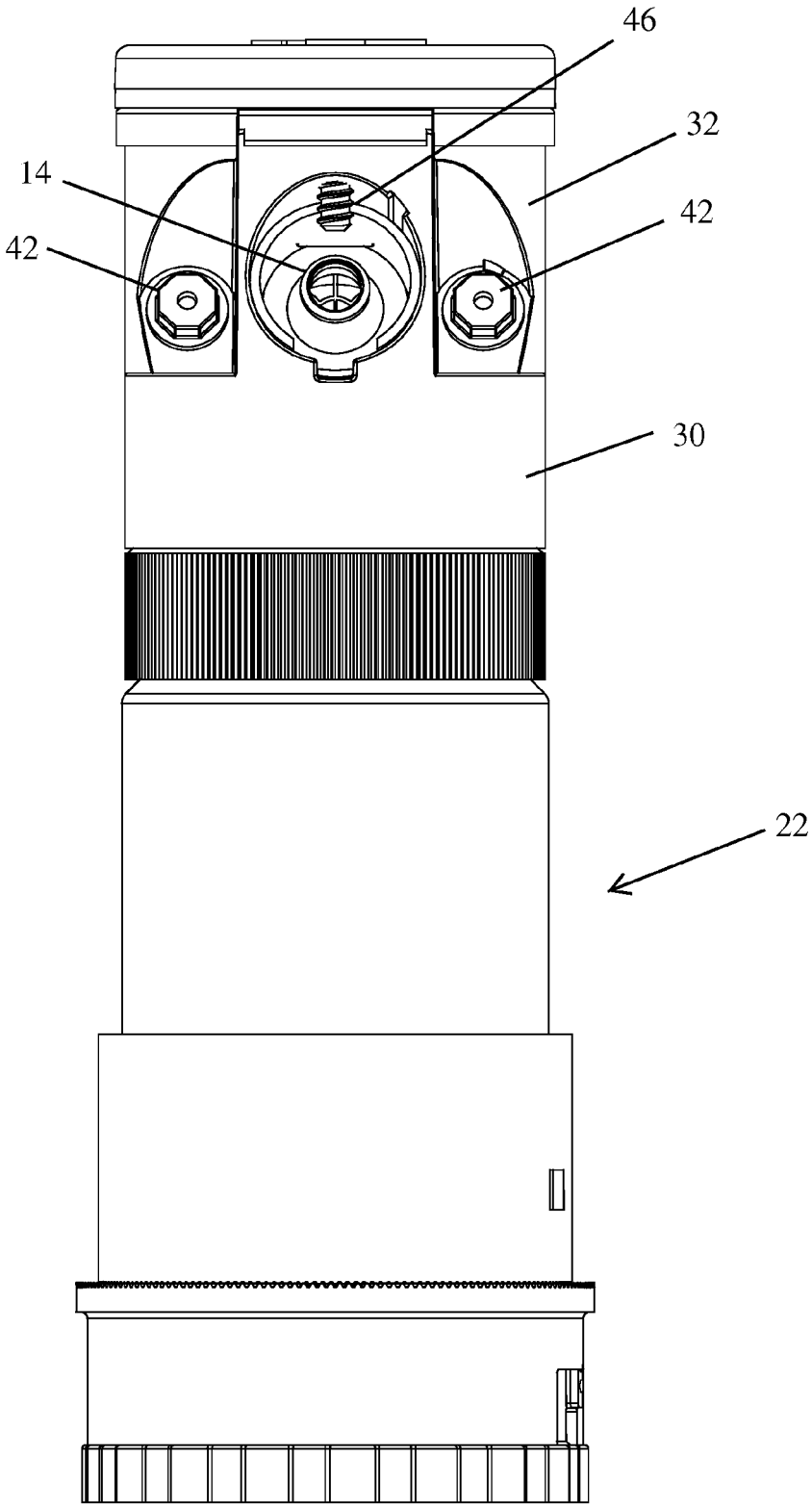
FIG. 14 is a view of the riser assembly of the sprinkler of FIG. 13 taken from the front side with secondary nozzles installed on the same side as the primary nozzle.
Figure 15:
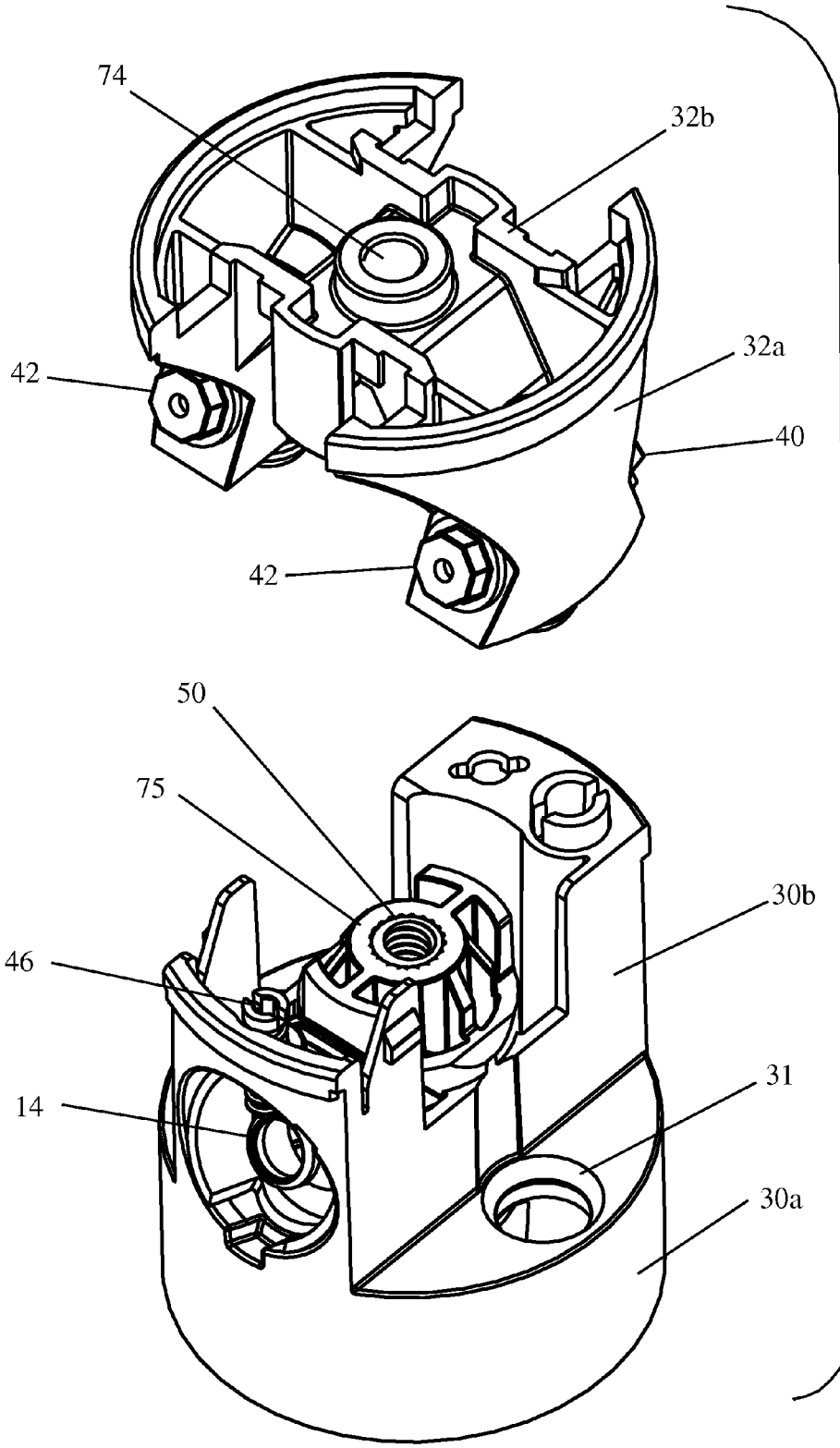
FIG. 15 is a partially exploded isometric view of the nozzle turret and the secondary nozzle holder similar to FIG. 10 but with two secondary nozzles installed on the same side as the primary nozzle.

FIGS. 13-15 illustrate the sprinkler 10 configured for part circle operation. In this configuration a pair of secondary nozzles 42 (FIG. 14) are positioned on the front side of the riser assembly 22 in order to emit water in the same direction as the primary nozzle 14. The secondary port plugs 40 (FIG. 13) are positioned on the rear side of the riser assembly in order to prevent water from emitting out of the rear side of the sprinkler 10.

As best seen in FIG. 15 the nozzle turret 30 has an inverted T-shape including a cylindrical base portion 30*a* and a vertical generally rectangular portion 30*b* that extends diametrically across the base portion 30*a*. The secondary nozzle holder 32 has an inverted U-shape that includes a pair of spaced apart vertically extending leg portions 32*a* and a generally horizontal connecting portion 32*b* in which the bore 74 is formed through which the attachment screw 58 extends. The leg portions 32*a* of the secondary nozzle holder 32 are received on opposite sides of the rectangular portion 30*b* of the nozzle turret 30 when the secondary nozzle holder 32 is mated with the nozzle turret 30. The vertical planar faces on the opposite sides of the rectangular portion 30*b* of the nozzle turret 30 are engaged by mating vertical planar faces on the inner sides of the leg portions 32*a* of the secondary nozzle holder 32. The symmetrical mating configuration of the nozzle turret 30 and the secondary nozzle holder 32 allow the secondary nozzle holder 32 to be attached to the nozzle turret 30 in different orientations. Referring to FIG. 11, the secondary nozzle holder 32 can be twisted one hundred and eighty degrees from the orientation illustrated before being secured to the nozzle turret 30 with the retention screw 58.

While we have described and illustrated in detail an embodiment of a sprinkler with a rotating nozzle turret that carries a removable and re-configurable secondary nozzle holder, it should be understood that our invention can be modified in both arrangement and detail. For example secondary nozzles can be placed in any position required to irrigate the landscape. There may be secondary nozzles 42 and/or 44 placed in any one, two three or four of the available positions in the secondary nozzle holder 32. Plugs 40 to prevent water flow may be placed in any of the positions where the secondary nozzles 42 and/or 44 are not installed. There may be more or fewer positions in the secondary nozzle holder 32 to install the secondary nozzles 42 and/or 44. The primary nozzle 14 could be integrally molded into the nozzle turret 30. The secondary nozzles 42 and/or 44 could be integrally molded into the secondary nozzle holder. Therefore, the term "nozzle" as used herein includes any port, orifice or other opening that forms and/or ejects a stream of water over the adjacent landscaping, regardless of whether the nozzle is incorporated into a removable generally tubular structure such as those illustrated herein in the form of nozzles 14, 42 and 44. Additionally, the riser assembly 22 could be used as a fixed riser without the outer housing 18. It is not necessary for the reversing mechanism 13 to be gear driven. The flow tubes 36 could be formed on the nozzle turret 30 instead of the secondary nozzle holder 32. Therefore the protection afforded our invention should only be limited in accordance with the following claims.

We claim:

1. An irrigation sprinkler, comprising:

a riser assembly including a rotatably mounted nozzle turret having a nozzle socket, a secondary nozzle holder removably mounted on the nozzle turret, and a turbine;

a drive assembly mounted in the riser assembly and coupling the turbine and the nozzle turret so that pressurized water entering a lower end of the riser assembly will cause the nozzle turret to rotate;

a primary nozzle removably mounted in the nozzle socket of the nozzle turret;

at least one secondary nozzle in the secondary nozzle holder; and wherein the second nozzle holder and the nozzle turret have a symmetrical mating configuration so that the secondary nozzle holder can be mounted on the nozzle turret in a first orientation rotationally fixed with respect to the nozzle turret and in a second orientation rotationally fixed with respect to the nozzle turret, and wherein the secondary nozzle can eject water in a same direction as the primary nozzle when the secondary nozzle holder is mounted in the first orientation or in an opposite direction when the secondary nozzle holder is mounted in the second orientation.

2. The sprinkler of claim 1 and further comprising a retention tab formed in the secondary nozzle holder that retains the primary nozzle in the socket.

3. The sprinkler of claim 1 wherein the secondary nozzle is removable from the secondary nozzle holder and the secondary nozzle holder is formed with at least one secondary nozzle port for removably receiving the secondary nozzle.

4. The sprinkler of claim 3 wherein the secondary nozzle includes a male threaded portion that screws into female threads formed in the secondary nozzle port.

5. The sprinkler of claim 1 wherein the secondary nozzle holder is attached to the nozzle turret by a fastener.

6. The sprinkler of claim 5 and further comprising a locking retention mechanism for holding the secondary nozzle holder to the nozzle turret if pressurized water is supplied to the riser assembly before the fastener has been used to secure the secondary nozzle holder and the nozzle turret together.

7. The sprinkler of claim 1 wherein the secondary nozzle holder has a first pair of secondary nozzle ports formed on a front side thereof and a second pair of secondary nozzle ports formed on a rear side thereof.

8. The sprinkler of claim 7 wherein the socket that removably receives the primary nozzle is located between one of the pairs of secondary nozzle ports.

9. The sprinkler of claim 1 wherein the nozzle turret has an inverted T-shape and the secondary nozzle holder has an inverted U-shape.

10. An irrigation sprinkler, comprising:

a riser assembly including a rotatable nozzle turret and a secondary nozzle holder removably mounted on the nozzle turret, the riser assembly including a drive assembly for rotating the nozzle turret, the nozzle turret having a nozzle receiving socket that opens on a front side of the nozzle turret, the secondary nozzle holder having a first pair of secondary nozzle ports that communicate via a pair of flow tubes with an interior of the nozzle turret and open on a front side of the secondary nozzle holder on opposite sides of the nozzle receiving socket, and a second pair of secondary nozzle ports that communicate via the pair of flow tubes with the interior of nozzle turret and open on a rear side of the secondary nozzle holder, the pair of flow tubes positioned on opposite sides of the nozzle receiving socket.

11. An irrigation sprinkler, comprising:

an axially extending riser assembly;

a turbine;

a nozzle turret having a first axially extending outer wall, the nozzle turret being mounted at an upper end of the riser assembly and having an axially extending primary port that communicates with an exit port that extends at a predetermined angle relative to the primary port and provides a nozzle receiving socket;

a drive assembly mounted in the riser assembly and coupling the turbine and the nozzle turret so that pressurized water entering the riser assembly will cause the nozzle turret to rotate;

a secondary nozzle holder configured to be removably mounted on the nozzle turret in a first orientation rotationally fixed with respect to the nozzle turret and in a second orientation rotationally fixed with respect to the nozzle turret, the secondary nozzle holder having a second axially extending outer wall axially aligned with the first axially extending outer wall of the nozzle turret; and at least one secondary nozzle in the secondary nozzle holder;

wherein the first axially extending outer wall and the second axially extending outer wall form a cylindrical outer wall when the secondary nozzle holder is removably mounted on the nozzle turret.

12. The sprinkler of claim 11 wherein the secondary nozzle ports are located on opposite sides of the nozzle receiving socket.

13. The sprinkler of claim 11 wherein the secondary nozzle holder has a first pair of secondary nozzle ports on a first side of the secondary nozzle holder and a second pair of secondary nozzle ports on a second side of the secondary nozzle holder, and further wherein a pair of secondary nozzles is mounted in the first pair of secondary nozzle ports and a pair of secondary plugs is mounted in the second pair of secondary nozzle ports.

14. The sprinkler of claim 11 wherein the secondary nozzle holder has a pair of flow tubes that are removably received in corresponding cavities in the nozzle turret.

15. The sprinkler of claim 14 and further comprising a pair of O-rings each surrounding a corresponding flow tube when the flow tubes are received in the cavities in the nozzle turret to provide seals between the nozzle turret and the secondary nozzle holder.

16. The sprinkler of claim 11 wherein the secondary nozzle holder is attached to the nozzle turret by a fastener and further comprising a locking retention mechanism for holding the secondary nozzle holder to the nozzle turret if pressurized water is supplied to the riser assembly before the fastener has been used to secure the secondary nozzle holder and the nozzle turret together.

17. The sprinkler of claim 11 and further comprising a retention tab formed in the secondary nozzle holder that retains the primary nozzle in the socket.

18. The sprinkler of claim 11 wherein the nozzle turret and the secondary nozzle holder have substantially a same outer diameter as the riser assembly.

* * * * *